US011408598B2

(12) United States Patent
Zeng

(10) Patent No.: US 11,408,598 B2
(45) Date of Patent: Aug. 9, 2022

(54) ROTATING ARM STRUCTURE OF LAMP AND LAMP WITH THE ROTATING ARM STRUCTURE

(71) Applicants: Self Electronics Co., Ltd., Zhejiang (CN); Wanjiong Lin, Zhejiang (CN); Self Electronics USA Corporation, Norcross, GA (US)

(72) Inventor: Guoqing Zeng, Zhejiang (CN)

(73) Assignee: Self Electronics Co., Ltd., Ningbo (CN)

( * ) Notice: Subject to any disclaimer, the term of this patent is extended or adjusted under 35 U.S.C. 154(b) by 0 days.

(21) Appl. No.: 17/301,339

(22) Filed: Mar. 31, 2021

(65) Prior Publication Data

US 2022/0128227 A1 Apr. 28, 2022

(30) Foreign Application Priority Data

Oct. 22, 2020 (CN) ..... 202011142009.8

(51) Int. Cl.
*F21V 21/30* (2006.01)
*F21V 21/116* (2006.01)
*F21V 21/26* (2006.01)

(52) U.S. Cl.
CPC ..... *F21V 21/30* (2013.01); *F21V 21/116* (2013.01); *F21V 21/26* (2013.01)

(58) Field of Classification Search
CPC ..... F21V 21/30; F21V 21/26; F21V 21/116
See application file for complete search history.

(56) References Cited

U.S. PATENT DOCUMENTS

| | | | | |
|---|---|---|---|---|
| 8,708,535 | B2 * | 4/2014 | Dalsgaard | F21V 21/30 362/426 |
| 2013/0322100 | A1 * | 12/2013 | Lowry | F21V 17/10 362/427 |
| 2016/0281968 | A1 * | 9/2016 | Sung | F21V 21/116 |
| 2018/0058647 | A1 * | 3/2018 | He | F21V 21/116 |
| 2018/0238526 | A1 * | 8/2018 | Rocchio | F21V 21/108 |
| 2020/0332986 | A1 * | 10/2020 | Xia | F21V 17/005 |

* cited by examiner

*Primary Examiner* — William N Harris
(74) *Attorney, Agent, or Firm* — Wang Law Firm, Inc.

(57) ABSTRACT

A rotating arm structure of a lamp includes a rotating arm body; rotating shaft, arranged on the rotating arm body; rotating shaft base, arranged on an lamp body and being in interference fit with the rotating shaft; the rotating shaft base includes base, being with top surface provided with an arc-shaped groove that is rotationally matched with the rotating shaft, and the base is provided with a limiting structure limiting the axial movement of the rotating shaft; elastic pressing piece, located directly above the arc-shaped groove, and two ends are pressed down and fixed and middle part are bend upward and compresses the rotating shaft on the base. The structure is simple, and the installation is convenient, which can effectively reduce the manufacturing cost while keeping the lamp body stable and smooth.

14 Claims, 4 Drawing Sheets

ROTATING ARM STRUCTURE OF LAMP AND LAMP WITH THE ROTATING ARM STRUCTURE

RELATED APPLICATION

This application claims priority to a Chinese Patent Application No. CN 202011142009.8, filed on Oct. 22, 2020.

FIELD OF THE TECHNOLOGY

The invention relates to the technical field of lamp installation, in particular to a rotating arm structure of a lamp and a lamp with the rotating arm structure.

BACKGROUND OF THE INVENTION

There are many types of lamps in the prior art. Among them, one type of lamp is characterized in that it is restricted to be installed in a certain position, but its light projection direction needs to be adjusted and changed, such as a ceiling spotlight. Therefore, this kind of lamp is provided with a fixed part and a rotating part, and a connecting structure must be provided between the fixed part and the rotating part in order to realize the adjustment and change of the light projection direction. The connecting structure provided between the fixed part and the rotating part of the lamp is called the rotating arm. The rotating arm has the function of connecting the fixed part and the rotating part of the lamp, and rotating or positioning the rotating part relative to the fixed part, that is, the rotating arm is in a fixed state, and the lamp rotates relative to the rotating arm.

In order to achieve the function of positioning at the same time of rotation, generally, it achieves rotational positioning by tight-fitting connection or gear meshing. Tight-fitting connection methods are often used, and multiple disc springs are required. The compression force is used to control the axial pressure and thereby generate the rotational friction in the circumferential direction required for rotation therefore a large number of structural parts is required, resulting in a problem of high assembly costs.

BRIEF SUMMARY OF THE INVENTION

In view of this, the present invention provides a rotating arm structure of a lamp and a lamp with the rotating arm structure to solve the above technical problems.

A rotating arm structure of a lamp, comprising:

rotating arm body;

rotating shaft, arranged on the rotating arm body;

rotating shaft base, arranged on a lamp body and being in interference fit with the rotating shaft;

characterized in that, the rotating shaft base includes:

base, being with top surface provided with an arc-shaped groove that is rotationally matched with the rotating shaft, and the base is provided with a limiting structure limiting the axial movement of the rotating shaft;

elastic pressing piece, located directly above the arc-shaped groove, and two ends are pressed down and fixed and middle part are bend upward and compresses the rotating shaft on the base.

preferably, the limiting structure is a radial extending limiting slot, and the rotating shaft is provided with an expanded diameter section that is locked into the limit slot.

preferably, the elastic pressing piece is provided with a strip hole that avoids the collision the expanded diameter section.

preferably, the arc of the arc-shaped groove is less than or equal to 180°.

preferably, the material of the elastic pressing piece is 65Mn or stainless steel.

preferably, the material of the base is PC, ABS or POM.

preferably, a gasket is provided between the elastic pressing piece and the rotating shaft, and the material of the gasket is PC, ABS or POM.

preferably, the gasket is an arc-shaped structure, and two ends facing the base (301) abut against the base.

preferably, the gasket is a circular structure and is arranged between the arc-shaped groove and the rotating shaft.

preferably, the rotating shaft is provided with a radially extending limit protrusion, and the limit protrusion cooperates with the base to limit the rotation stroke of the rotating shaft.

A lamp, comprising a lamp body, the lamp body is connected to the rotating arm structure, and the base is disposed on the lamp body.

preferably, the base and the lamp body are integrally formed.

preferably, the lamp is a spotlight, the lamp body is cylindrical, and the inner cavity of the lamp body is separated into a light source cavity and an electrical cavity by a partition wall, the base is arranged on the partition wall, and the side wall of the lamp body is provided with a mounting hole which can pass through the rotating shaft.

preferably, the axis of the rotating shaft is perpendicular to the length direction of the rotating arm body.

Technical effects of the present invention:

The rotating arm structure of the lamp and the lamp with the rotating arm structure of the present invention have a simple structure and convenient installation, which can effectively reduce the manufacturing cost while keeping the lamp body stable and smooth.

BRIEF DESCRIPTION OF THE DRAWINGS

The embodiments of the present invention are described below in conjunction with the accompanying drawings, in which.

DETAILED DESCRIPTION OF THE INVENTION

Figure 1:
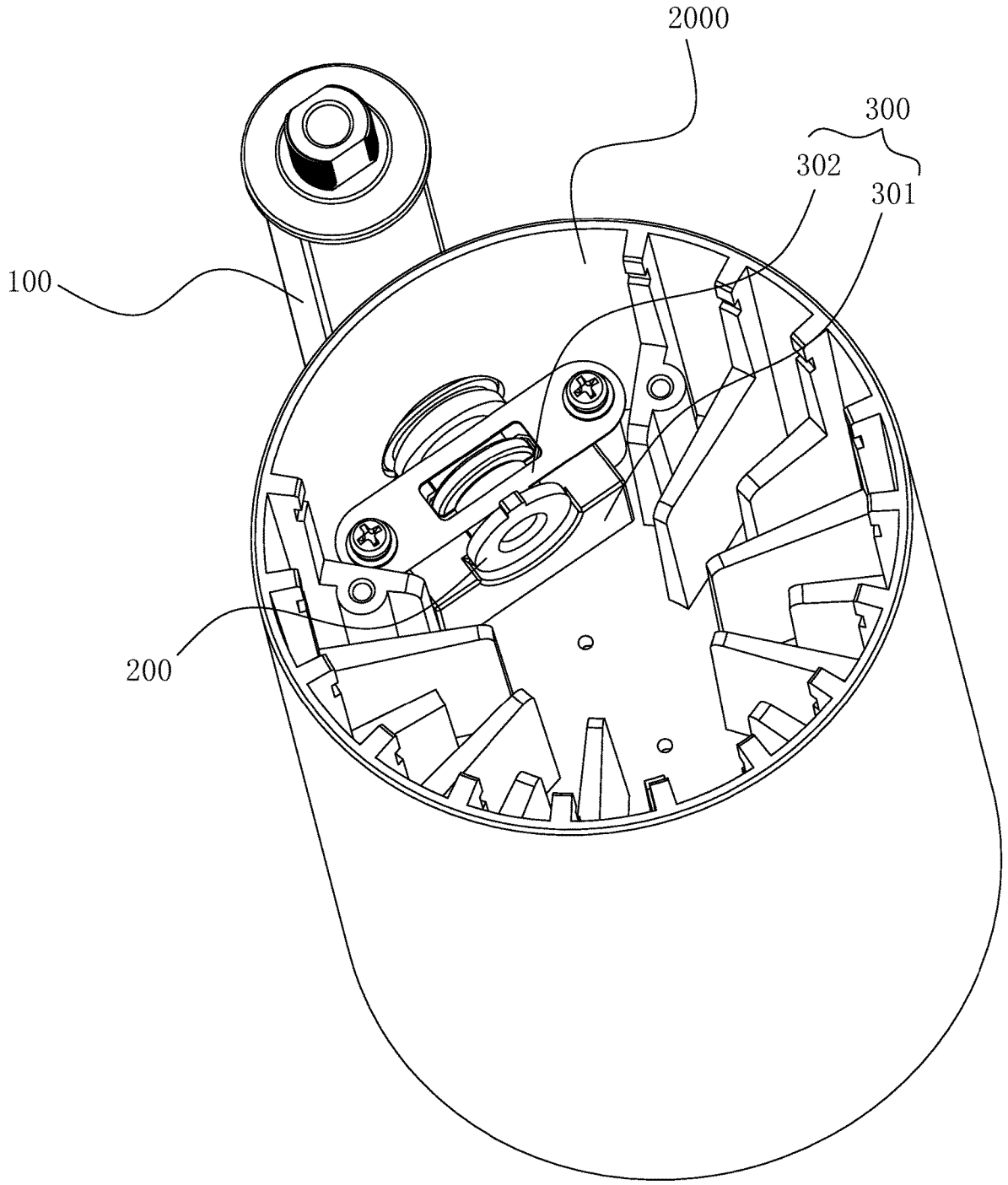
FIG. 1 is a schematic diagram of the structure of the lamp in this embodiment.

The embodiments of the present invention will be described in detail below. Examples of the embodiments are shown in the accompanying drawings, wherein the same or similar reference numerals indicate the same or similar elements or elements with the same or similar functions. The embodiments described below with reference to the accompanying drawings are exemplary, and are only used to explain the present invention, and cannot be understood as a limitation to the present invention.

Figure 2:
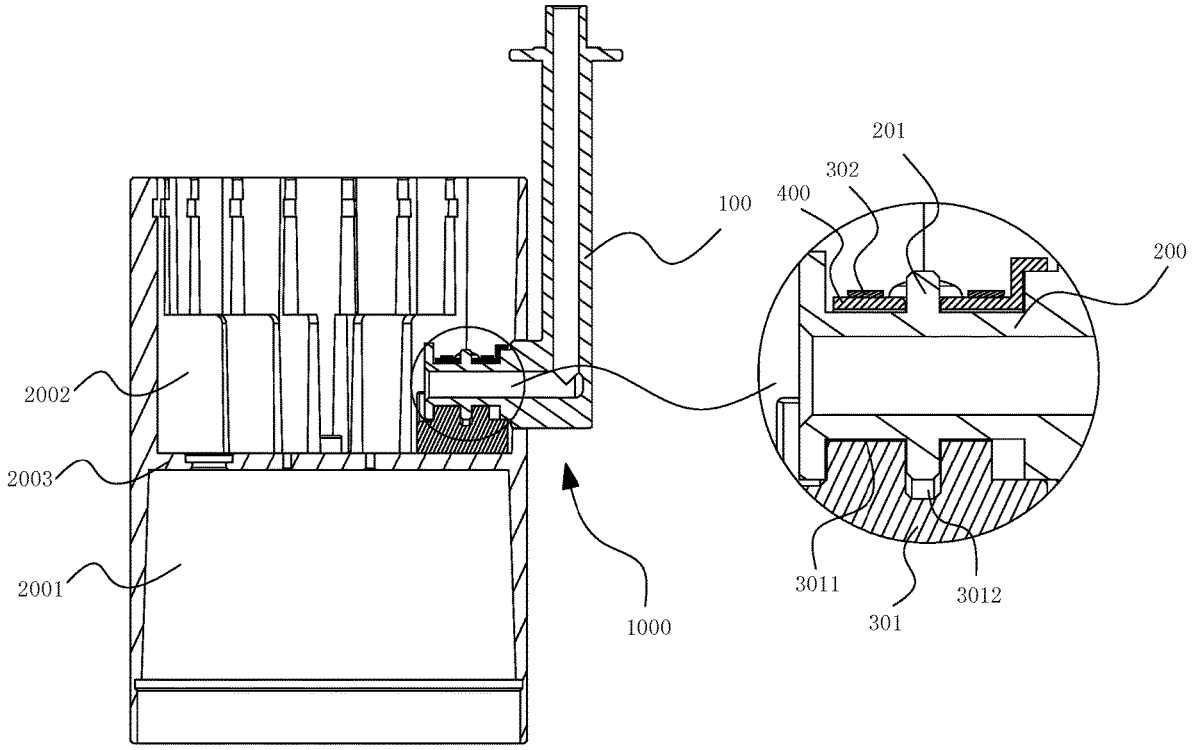
FIG. 2 is a schematic cross-sectional view of the lamp of this embodiment.
Figure 3:
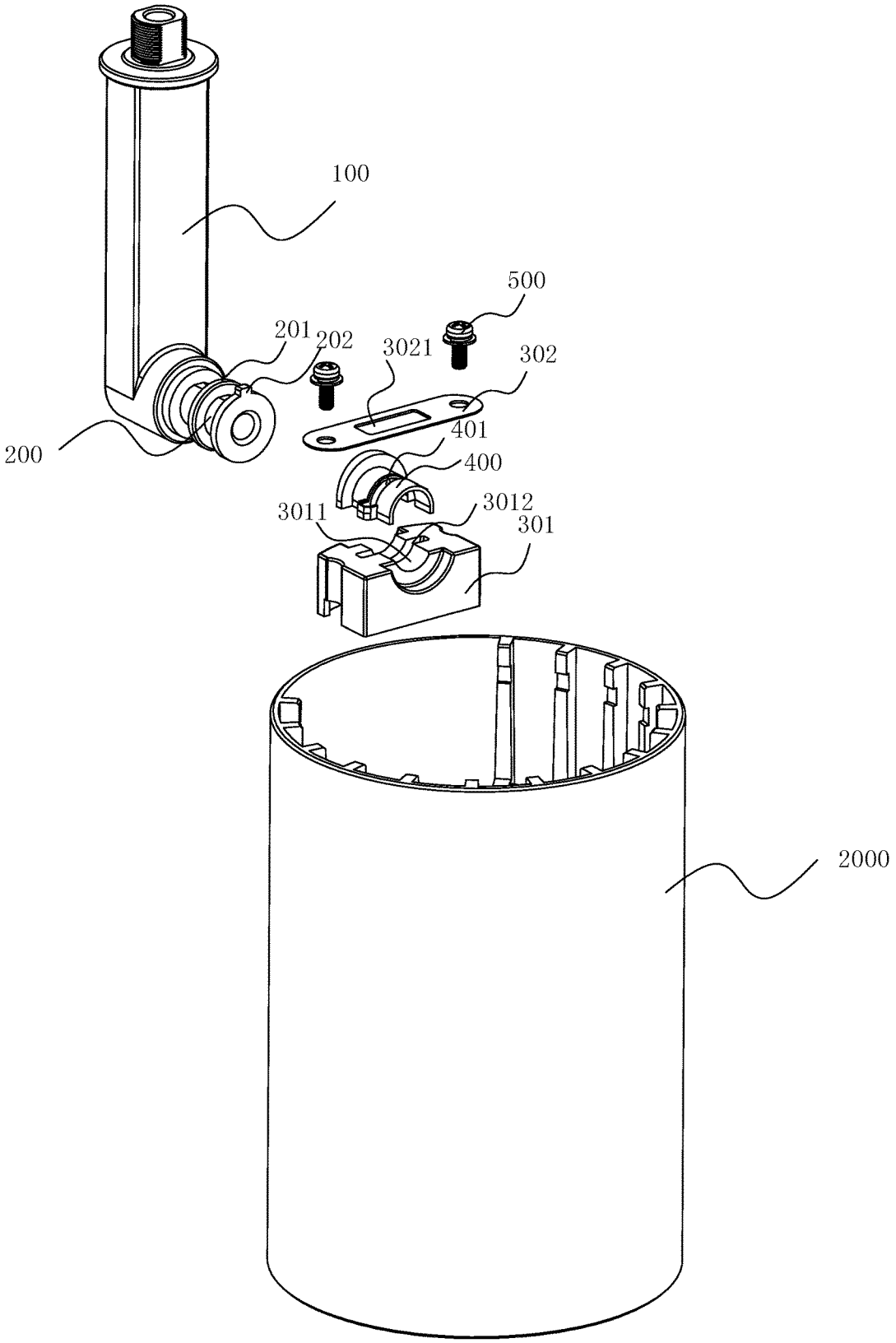
FIG. 3 is a schematic diagram of the exploded structure of the lamp in this embodiment.
Figure 4:
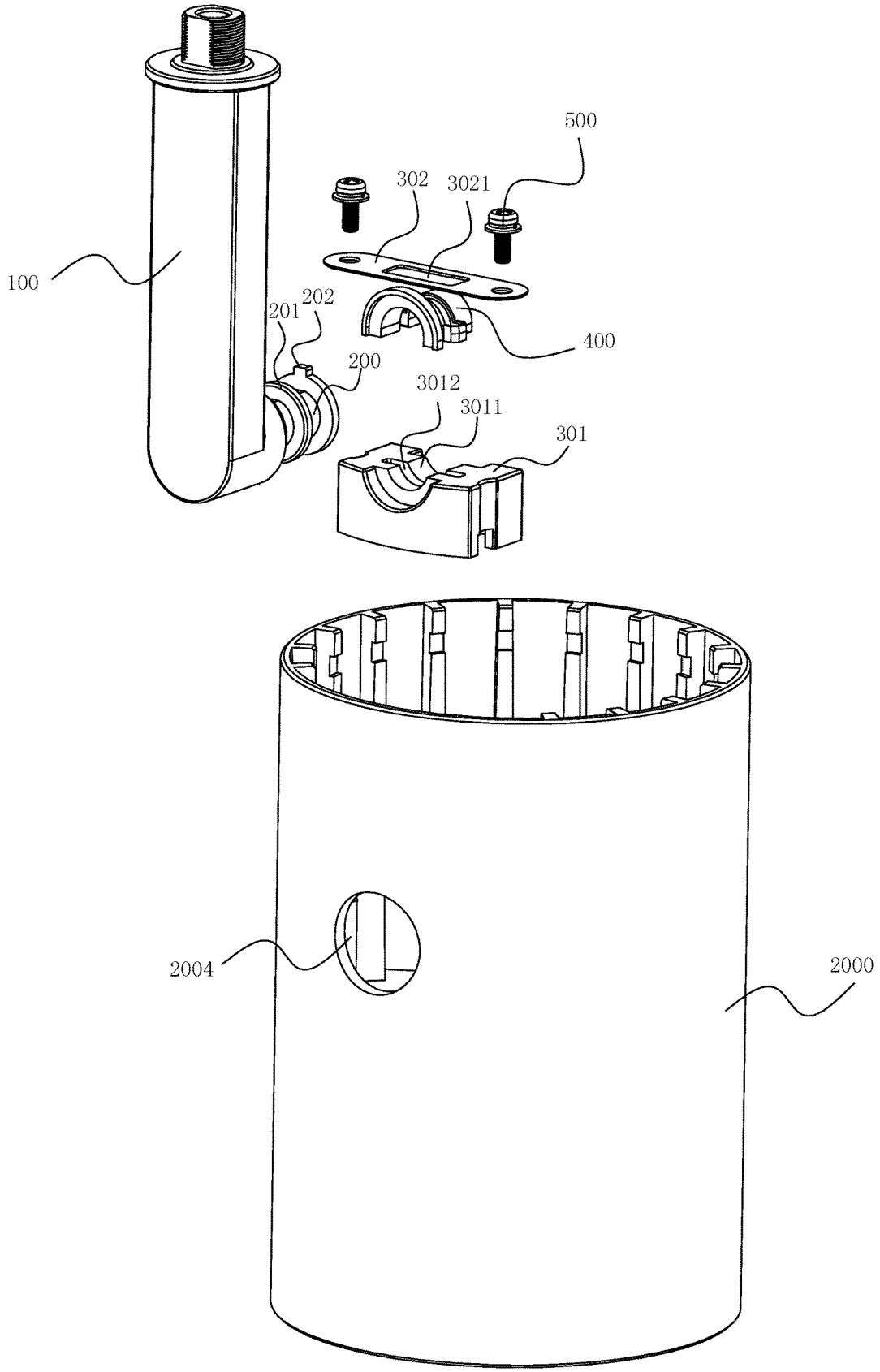
FIG. 4 is a schematic diagram of the exploded structure of the lamp of this embodiment at another angle.

As shown in FIGS. 1 to 4, the lamp of this embodiment includes a lamp body 2000 and a rotating arm structure 1000 connected to the lamp body 2000. The specific shape and structure of the lamp body 2000 in this embodiment can be set according to needs. In this embodiment, a spotlight is taken as an example. The lamp body 2000 is cylindrical, and the inner cavity of the lamp body 2000 is separated into a light source cavity 2001 and an electrical cavity 2002 by the partition wall 2003. Of course, other lamp types are also possible. In addition, the lamp may also include other components such as a light source, a driving power source, and a lamp cover. This is the prior art and will not be repeated here.

The rotating arm structure 1000 includes a rotating arm body 100, a rotating shaft 200 and a rotating shaft base 300. The rotating shaft 200 is arranged on the rotating arm body 100; the rotating arm body 100 is used to fix and install the lamp, and the lamp body rotates relative to the fixed installation position through the rotating arm body 100. The rotating shaft base 300 is disposed on the lamp body 2000 and is in an interference fit with the rotating shaft 200. Specifically, the rotating shaft base 300 includes a base 301 and an elastic pressing piece 302.

The base 301 is arranged on the lamp body 2000, the top surface is provided with an arc-shaped groove 3011 that is rotatable matched with the rotating shaft 200, and the base 301 is provided with a limiting structure 3012 that restricts the axial movement of the rotating shaft 200; The elastic pressing piece 302 is located directly above the arc-shaped groove 3011, and both ends are pressed down and fixed and the middle part is bent upward and presses the rotating shaft 200 on the base 301. Since the elastic pressing piece 302 has elasticity, the rotating shaft 200 can rotate in the arc-shaped groove 3011 while providing positioning friction. Through the above arrangement, the present invention realizes the interference fit connection between the rotating shaft 200 and the rotating shaft 200 with a simple structure, convenient installation, and stable and reliable rotation.

The limiting structure 3012 is to realize the axial positioning of the rotating shaft 200, and it is necessary to provide steps at the front and back in the axial direction. The actual form is not limited. In this embodiment, in order to facilitate installation and manufacturing, the limiting structure 3012 is radial extending limit slot, the rotating shaft 200 is provided with an expanded diameter section 201 that is locked into the limit slot.

In this embodiment, the elastic pressing piece 302 is provided with a strip hole 3021 that avoids the expanded diameter section 201. The pressure of the elastic pressing piece 302 can be applied to both sides of the expanded diameter section 201, the installation is more stable, and the expanded diameter section 201 can be further restricted.

In order to facilitate installation, in this embodiment, the arc of the arc-shaped groove 3011 is less than or equal to 180°. The rotating shaft 200 can be directly placed in the arc-shaped groove 3011 in the radial direction.

In this embodiment, the material of the elastic pressing piece 302 is 65Mn or stainless steel. The above two materials have good flexibility, are not easy to deform, and maintain a stable pressure.

The above-mentioned fixing method of pressing down and fixing at both ends can be realized by using fasteners or directly fixing the ends. Among them, there are many types of fasteners. In this embodiment, the anti-loosening screw 500 is used to keep the elastic pressing piece 302 at a stable pressure.

In order to better heat dissipation, the rotating shaft 200 and the lamp body 2000 are generally made of metal materials. If the base 301 is also made of a metal material with good heat dissipation, it will cause the rotating shaft 200 to rub against the base 301 and produce abnormal noise. Therefore, the material of the base 301 is PC, ABS or POM. These materials not only do not produce abnormal noise, but also have a certain degree of flexibility, which can make the rotation between the two more smooth.

In this embodiment, a gasket 400 is provided between the elastic pressing piece 302 and the rotating shaft 200, and the material of the gasket 400 is PC, ABS or POM. The above structure is also to prevent abnormal noise and make the rotation smoother. The gasket 400 is provided with a separation 401 that avoids the collision with the expanded diameter section 201.

In order to facilitate installation, in this embodiment, the gasket 400 has an arc-shaped structure, and the two ends facing the base 301 abut against the base 301.

In another embodiment, the gasket 400 has a circular structure and is arranged between the arc-shaped groove 3011 and the rotating shaft 200. At this time, the base 301 and the lamp body 2000 are integrally formed, and the base 301 can be made of a metal material.

In this embodiment, the rotating shaft 200 is provided with a limit protrusion 202 extending radially, and the limit protrusion 202 cooperates with the base 301 to limit the rotation stroke of the rotating shaft 200.

In this embodiment, in order to facilitate installation, the base 301 is arranged on the partition wall 2003, and the side wall of the lamp body 2000 is provided with an mounting hole 2004 passing through the rotating shaft 200. Further, the axis of the rotating shaft 200 is perpendicular to the length direction of the rotating arm body 100.

The above disclosure has been described by way of example and in terms of exemplary embodiment, and it is to be understood that the disclosure is not limited thereto. Rather, any modifications, equivalent alternatives or improvement etc. within the spirit of the invention are encompassed within the scope of the invention as set forth in the appended claims.

What is claimed is:

1. A rotating arm structure (1000) of a lamp, comprising:
- a rotating arm body (100);
- a rotating shaft (200), arranged on the rotating arm body (100);
- a rotating shaft base (300), arranged on a lamp body (2000) and being in interference fit with the rotating shaft (200);
- wherein the rotating shaft base (300) comprises:
  - a base (301), having a top surface provided with an arc-shaped groove (3011) that is rotationally matched with the rotating shaft (200), and the base (301) is provided with a limiting structure (3012) limiting an axial movement of the rotating shaft (200); and
  - an elastic pressing piece (302), located directly above the arc-shaped groove (3011), wherein two ends of the elastic pressing piece are pressed down and fixed, and a middle part of the elastic pressing piece is bent upward and compresses the rotating shaft (200) on the base (301).

2. The rotating arm structure (1000) of a lamp as claimed in claim 1, wherein the limiting structure (3012) is a radial extending limiting slot, and the rotating shaft (200) is provided with an expanded diameter section (201) that is locked into the limit slot.

3. The rotating arm structure (1000) of a lamp as claimed in claim 2, wherein the elastic pressing piece (302) is provided with a strip hole (3021) to avoid a collision with the expanded diameter section (201).

4. The rotating arm structure (1000) of a lamp as claimed in claim 1, wherein the arc of the arc-shaped groove (3011) is less than or equal to 180°.

5. The rotating arm structure (1000) of a lamp as claimed in claim 1, wherein the material of the elastic pressing piece (302) is carbon structural steel (65Mn) or stainless steel.

6. The rotating arm structure (1000) of a lamp as claimed in claim 1, wherein the material of the base (301) is polycarbonate (PC), acrylonitrile butadiene styrene (ABS), or polyoxymethylene (POM).

7. The rotating arm structure (1000) of a lamp as claimed in claim 1, wherein a gasket (400) is provided between the elastic pressing piece (302) and the rotating shaft (200), and the material of the gasket (400) is polycarbonate (PC), acrylonitrile butadiene styrene (ABS), or polyoxymethylene (POM).

8. The rotating arm structure (1000) of the lamp as claimed in claim 7, wherein the gasket (400) is an arc-shaped structure, two ends of the gasket facing the base (301) abut against the base (301).

9. The rotating arm structure (1000) of the lamp as claimed in claim 7, wherein the gasket (400) is a circular structure and is arranged between the arc-shaped groove (3011) and the rotating shaft (200).

10. The rotating arm structure (1000) of a lamp as claimed in claim 1, wherein the rotating shaft (200) is provided with a radially extending limit protrusion (202), and the limit protrusion (202) cooperates with the base (301) to limit a rotation stroke of the rotating shaft (200).

11. A lamp, comprising a lamp body (2000), characterized in that the lamp body (2000) is connected to the rotating arm structure (1000) as claimed in claim 1, and the base (301) is disposed on the lamp body (2000).

12. The lamp as claimed in claim 11, wherein the base (301) and the lamp body (2000) are integrally formed.

13. The lamp as claimed in claim 11, wherein the lamp is a spotlight, the lamp body (2000) is cylindrical, and the inner cavity of the lamp body (2000) is separated into a light source cavity (2001) and an electrical cavity (2002) by a partition wall (2003), the base (301) is arranged on the partition wall (2003), and a side wall of the lamp body (2000) is provided with a mounting hole (2004) which can pass through the rotating shaft (200).

14. The lamp as claimed in claim 11, wherein an axis of the rotating shaft (200) is perpendicular to a lengthwise direction of the rotating arm body (100).

* * * * *